US007431006B2

(12) United States Patent
Jankuski

(10) Patent No.: US 7,431,006 B2
(45) Date of Patent: Oct. 7, 2008

(54) SYSTEM AND METHOD FOR LUBRICATING POWER TRANSMITTING ELEMENTS

(75) Inventor: George A. Jankuski, Glenbeulah, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 11/615,411

(22) Filed: Dec. 22, 2006

(65) Prior Publication Data

US 2008/0149423 A1 Jun. 26, 2008

(51) Int. Cl.
*F01M 1/02* (2006.01)

(52) U.S. Cl. ..... 123/196 R

(58) Field of Classification Search ..... 123/196 R; 184/6.12, 11.1, 13.1, 6
See application file for complete search history.

(56) References Cited

U.S. PATENT DOCUMENTS

| | | | |
|---|---|---|---|
| 3,301,349 | A | 1/1967 | Williams |
| 3,621,937 | A | 11/1971 | Edge et al. |
| 3,635,048 | A | 1/1972 | Monti |
| 4,771,864 | A | 9/1988 | Lorimor et al. |
| 5,052,518 | A | 10/1991 | Trommer |
| 5,119,905 | A | 6/1992 | Murray |
| 5,687,612 | A | 11/1997 | Imamura |
| 6,183,230 | B1 | 2/2001 | Beardmore |
| 6,192,853 | B1 | 2/2001 | Natsume |
| 6,736,023 | B1 * | 5/2004 | Sumi et al. ..... 74/440 |

FOREIGN PATENT DOCUMENTS

| | | | |
|---|---|---|---|
| EP | 15361544 | A | 6/2005 |
| FR | 2839750 | A1 | 11/2003 |
| FR | 2877702 | A | 5/2006 |
| GB | 191327545 | A | 0/1914 |
| GB | 2384160 | A | 7/2003 |
| WO | 9964728 | A | 12/1999 |

* cited by examiner

*Primary Examiner*—Stephen K. Cronin
*Assistant Examiner*—Hyder Ali
(74) *Attorney, Agent, or Firm*—Whyte Hirschboeck Dudek SC

(57) ABSTRACT

Disclosed herein is a lubrication system and method. The system includes a main engine bearing and a crankshaft in operational association with the bearing. The crankshaft includes an end having a cavity with a power transmitting element (e.g., splines). The cavity can receive and engage an additional mechanism to transmit power thereto. The crankshaft further includes a first oil passage that is disposed within the end and a second oil passage that extends from the main engine bearing into the crankshaft. The first oil passage intersects the second oil passage. The system also includes a pump mechanism for circulating lubricating oil from the main engine bearing to the crankshaft through the second oil passage and the first oil passage, and to the cavity to lubricate the power transmitting element. During engine operation, a constant supply of lubricating oil can be provided to the power transmitting element to reduce component wear.

22 Claims, 2 Drawing Sheets

SYSTEM AND METHOD FOR LUBRICATING POWER TRANSMITTING ELEMENTS

CROSS-REFERENCE TO RELATED APPLICATIONS

STATEMENT REGARDING FEDERALLY SPONSORED RESEARCH OR DEVELOPMENT

FIELD OF THE INVENTION

The present invention relates to a lubrication system, and more particularly to a system and method for lubricating power transmitting elements. In one aspect, the invention relates to a spline lubrication system.

BACKGROUND OF THE INVENTION

Without proper lubrication to flush away or otherwise remove contaminants, power transmitting elements in engines progressively wear during use. Such wear results in decreased service life of a given piece of equipment. For example, a typical engine with a crankshaft employing internal splines may have a desired service life of 1500 hours. However, during engine use, the slight relative movement between the internal splines and the complementary external splines of an additional component engaged with the internal splines results in fretting and/or corrosion on the splines such that routine maintenance may be required after only 200 hours of use, or perhaps even less.

Accordingly, it would be desirable to provide a system and method for lubricating power-transmitting elements, such as splines, to reduce wear and to increase service life of such elements during use. Such a solution would, advantageously, reduce the amount of time and costs associated with maintaining equipment incorporating such power transmitting elements.

BRIEF SUMMARY OF THE INVENTION

In one aspect, the present invention relates to a lubrication system for lubricating a power transmitting element in an engine. The system includes a main engine bearing, and a crankshaft in operational association with the main engine bearing. The crankshaft includes an end that has a cavity having a power transmitting element, and the cavity is capable of receiving and engaging an additional mechanism so as to transmit power thereto. The crankshaft further includes a first oil passage that is centrally disposed within the end and a second oil passage that extends from a main engine bearing into the crankshaft such that the first oil passage intersects the second oil passage. The system also includes a pump mechanism for circulating lubricating oil from the main engine bearing to the crankshaft through the second oil passage and the first oil passage, and then to the cavity so as to lubricate the power transmitting element. In one embodiment, the power transmitting element can include splines or a splined surface.

In another aspect, a method for lubricating one or more power transmitting elements in an engine is also disclosed.

Advantageously, during engine operation, a constant or substantially constant supply of lubricating oil can be provided to the power transmitting element so as to reduce component wear and, desirably, extend component service life.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals are used to indicate like components. In the drawings.

DETAILED DESCRIPTION OF THE PREFERRED EMBODIMENTS

Figure 1:
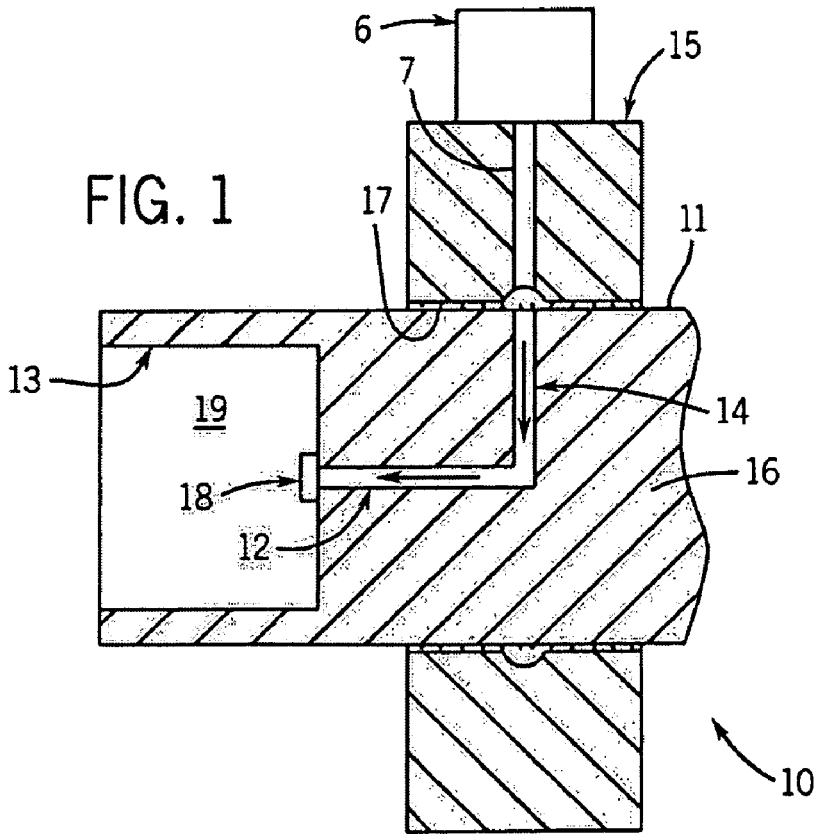
FIG. 1 is a schematic illustration of one embodiment a system for lubricating a power transmitting element on an engine crankshaft according to one aspect of the present invention.

FIG. 1 illustrates a schematic illustration of one embodiment of a system 10 for lubricating a power transmitting element, such as a spline, a keyway, and the like (not shown), via an engine crankshaft 16 in accordance with at least one aspect of the present invention. A first oil passage 12 is provided in the center of an end 11 of the crankshaft 16. As shown, and in accordance with at least one embodiment of the present invention, the end 11 is the Power Take-Off (PTO) end of the crankshaft 16. It is contemplated and considered within the scope of the present invention, however, that another location on the crankshaft may be used, including by way of example, the end opposite the PTO end. The end 11 includes a cavity 19 with a surface 13 that includes a power-transmitting element(s) (not shown). The cavity 19 is capable of receiving an additional mechanism (also not shown) that is capable of contacting or engaging the power transmitting element used in conjunction with surface 13. A second oil passage 14 is provided that extends, as shown, radially inward into the crankshaft 16 from a main engine bearing 15 (e.g., a rear main engine bearing). The first oil passage 12 intersects the second oil passage 14.

Lubricating oil 17, circulated to the rear bearing 15 by means of an existing engine oil pump or pumping mechanism 6, flows via a bearing passage 7, through the second oil passage 14 to the first oil passage 12 and then to the center of the cavity 19. A flow reducing orifice 18 is provided, typically in the first passage 12, to control the flow of lubricating oil 17 to the cavity 19. The lubricating oil 17 arriving at or near the center of the cavity 19 can then proceed outward to the inwardly-facing surface 13, and thus can eventually be used to lubricate both the surface 13 having the power-transmitting element (again not shown) and any additional component that is inserted into the cavity 19. In this fashion, a constant supply of lubricating oil is provided to the power transmitting element to flush away contaminant(s) contained therein or thereon during operation of the engine.

In at least some embodiments, in addition to the lubricating oil 17 being provided to the power transmitting element (e.g., an internal spline), as well as any interfacing element (e.g., a complementary external spline), it is possible that the lubricating oil 17 can also be further communicated to other devices by way of such additional components as are coupled to the crankshaft (e.g., PTO end) by way of the power transmitting elements. For example, if an additional component having an interfacing element (e.g., an external spline) also included a clutching mechanism (e.g., a multiple disc hydraulic actuated clutch), pressurized oil could be supplied from the center of the cavity 19 (as provided by the first oil passage 12 to a receiving passage within the external spline and subsequently to the clutching mechanism.

Figure 2:
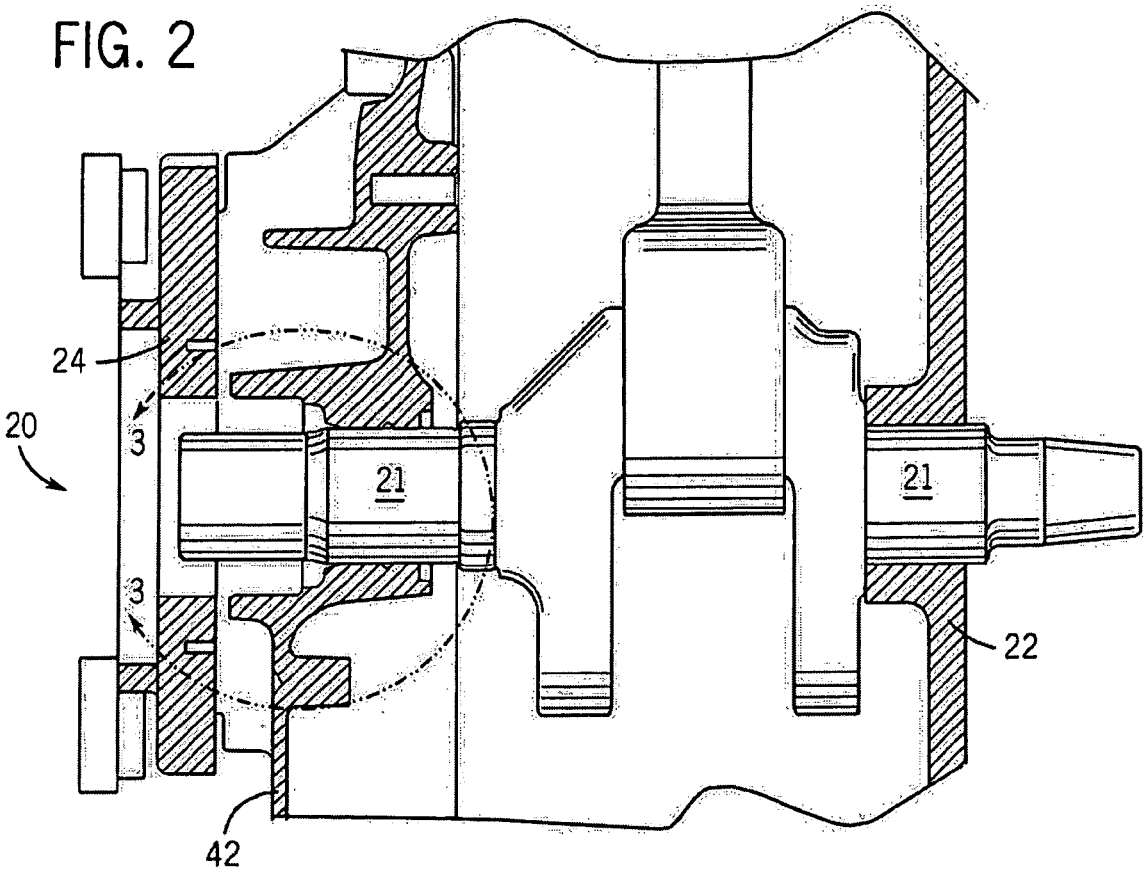
FIG. 2 is a sectional view of one embodiment of a PTO end of an internally splined engine crankshaft in accordance with one aspect of the present invention.

Turning to FIG. 2 and in accordance with one aspect of the present invention, a sectional view of one embodiment of a PTO end 20 of an internally splined engine crankshaft 21 is shown. The crankshaft 21 is rotatively supported, as shown via a crankcase 22. An adapter plate 24 is also shown and it is contemplated that, while not illustrated, a pump (e.g., a hydraulic pump of the kind noted above) can be and typically is secured to the adapter plate 24. The pump serves to circulate lubrication oil through the crankshaft as noted below. An engine closure plate 42 is also shown and is described further with respect to FIG. 3. As noted above, the end 20 is the PTO end of the crankshaft 21. However, it is again contemplated that, in at least some embodiments of the present invention, lubrication can be accomplished at another location on the crankshaft, including by way of example, the end opposite the PTO end.

Figure 3:
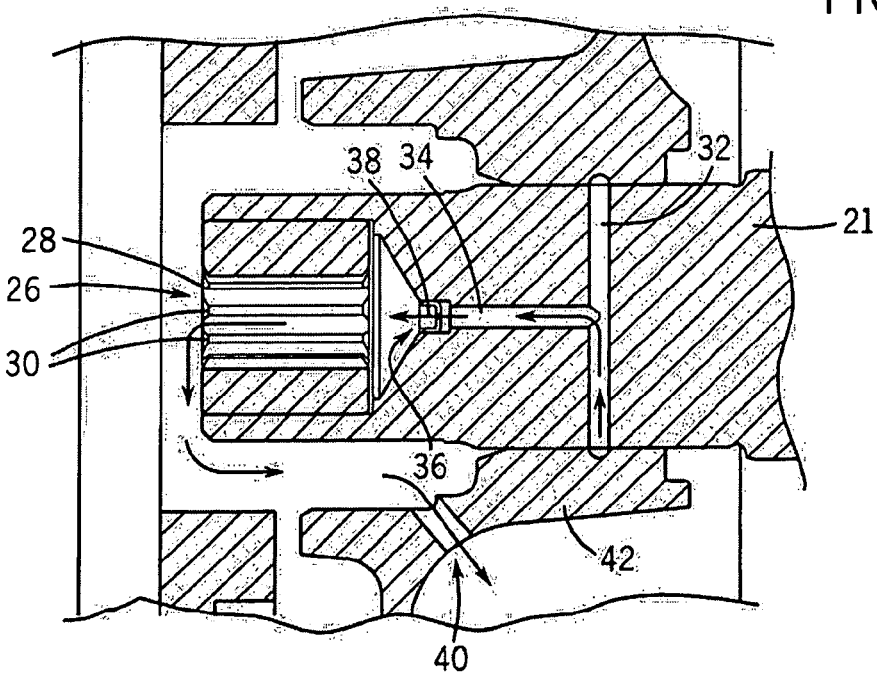
FIG. 3 is an enlarged detailed sectional view taken along line 2-2 of FIG. 2 showing spline lubrication in accordance with one aspect of the present invention.

FIG. 3 is an enlarged detailed sectional view taken along line 3-3 of FIG. 2. The internally splined engine crankshaft 21, supported by the crankcase (FIG. 2) is again shown. The end 20 includes a cavity 26 with a surface 28 that includes internal splines 30 (or spline teeth). The cavity 26 is capable of receiving an additional mechanism (not shown) having a surface with external splines that are capable of contacting or engaging, and thus are complementary with, the internal splines 30 of surface 28. A second oil passage 32 is provided that extends, as shown, radially inward into the crankshaft 21. A first oil passage 34, adjacent to cavity 26, intersects the second oil passage 32. The first oil passage 34 is provided at or around the center of the crankshaft 21. In one embodiment, first and second oil passages are created by drilling the passages into the crankshaft, with the second oil passage cross-drilled vertically into the crankshaft. It is noted here that while an internally splined engine crankshaft capable of receiving or engaging an additional mechanism having an external spline is shown, it should be understood that, if desired, such spline patterns may be reversed (e.g., the crankcase may employ an external spline capable of receiving an internal spline of an additional component). Also, as noted above with respect to FIG. 1, while splines are illustrated here, other power-transmitting elements are contemplated and considered within the scope of the present invention. Finally, while the first and second oil passages are shown to intersect each another at approximately a 90 degree angle and at or near the center of the crankshaft, other angles and locations are contemplated and considered within the scope of the present invention. The size and specific shape of the passages can also very to convenience.

As indicated by the arrows, lubricating oil is circulated to the rear bearing (not shown) by means of an existing engine oil lubrication pump (also not shown). The oil then flows through the second oil passage 34 to the first oil passage 32 and then to the cavity 26. Advantageously, a flow reducing orifice 36 is provided, typically in the first passage 32, to control the flow of lubricating oil to the cavity 26, and specifically the internal splines 30. To accomplish the flow-reduction, a plug 38 is included and driven or otherwise secured within the orifice. One plug that is suitable for use in the present invention to control oil flow to the internal splines is Cup Plug, part no. 24 139 05, available from Kohler, Co., located in Kohler, Wis. As further illustrated by the arrows, the lubricating oil arriving at the cavity 26 can then proceed to lubricate internal splines 30 of surface 28, as well as any additional component(s) that is inserted into the cavity 26. Crankshafts often include a seal that prevents oil from dripping out of the engine. As shown in the present embodiment, such a seal is removed or eliminated, and instead, a passageway 40 is drilled or otherwise formed in a closure plate 42. Passageway 40 defines or provides a return oil path by which the lubricating oil is returned to the engine oil pump (not shown), for example via a crankcase sump (also not shown). In this way, a constant or substantially constant supply of lubricating oil is provided to the splines so as to remove contaminants during engine operation.

End use applications for the above invention include, but are not limited to, low cost utility engines (e.g., twin engines, single engines, etc.). Engines contemplated for use in the present invention include Command® Engines, also manufactured by Kohler, Co., located in Kohler, Wis.

It is specifically intended that the present invention not be limited to the embodiments and illustrations contained herein, but include modified forms of those embodiments including portions of the embodiments and combinations of elements of different embodiments as come within the scope of the following claims.

I claim:

1. A system for lubricating splines on an engine crankshaft, the system comprising:

a main engine bearing;

a crankshaft in operational association with the main engine bearing, the crankshaft having a power take-off (PTO) end with a cavity having a surface with either internal or external splines, the cavity capable of receiving an additional mechanism with a surface having complementary splines, the crankshaft further including a first oil passage that is substantially centrally disposed with in the PTO end and a second oil passage that intersects the first oil passage; and a pump mechanism for circulating oil to the main engine bearing such that lubricating oil flows from the main engine bearing to the crankshaft through the second oil passage and the first oil passage, and then to the cavity.

2. The system of claim 1 wherein a flow reducing orifice is provided to control the flow of lubricating oil to the cavity.

3. The system of claim 2 further comprising a plug located within the orifice to accomplish lubricating oil flow reduction.

4. The system of claim 2 wherein the first oil passage includes the flow reducing orifice.

5. The system of claim 1 wherein the lubricating oil arriving at the cavity proceeds outwardly to inwardly-facing surfaces of internal splines and serves to lubricate both the internal splines and any complementary external splines of any additional mechanism that is inserted into and meshed with the internal splines.

6. The system of claim 1 wherein any additional component having the complementary splines comprises a clutching mechanism and oil is provided from the first oil passage to the cavity and then supplied from the cavity to the clutching mechanism.

7. The system of claim 6 wherein the oil is provided from the cavity to the clutching mechanism via a receiving passage within the complementary splines.

8. The system of claim 1 wherein the second oil passage extends radially inward in the crankshaft from the main engine bearing and intersects the first oil passage at about a 90 degree angle.

9. A lubrication system for use with an engine, the system comprising:

a main engine bearing;

a crankshaft in operational association with the main engine bearing, the crankshaft having an end that includes a cavity having a power transmitting element, the cavity capable of receiving and engaging an additional mechanism so as to transmit power thereto, the crankshaft further including a first oil passage that is substantially centrally disposed with in the end and a second oil passage that extends from a main engine bearing into the crankshaft such that the first oil passage intersects the second oil passage; and a pump mechanism for circulating lubricating oil from the main engine bearing to the crankshaft through the second oil passage and the first oil passage, and then to the cavity so as to lubricate the power transmitting element.

10. The system of claim 9 further comprising a flow reducing orifice having a plug secured therein, the plug provided to control the flow of lubricating oil to the cavity.

11. The system of claim 10 wherein the first oil passage includes the flow reducing orifice.

12. The system of claim 9 wherein then end is the power take-off (PTO) end.

13. The system of claim 9 wherein lubricating oil is provided to the power transmitting element with any lubrication fluid dam on any side of a clutch assembly.

14. The system of claim 9 wherein, during engine operation, a constant supply of lubricating oil is provided to the power transmitting element.

15. The system of claim 9 wherein the engine is a utility engine.

16. A method for lubricating an engine power transmitting element, the method comprising:

providing a lubrication system, the lubrication system including:

a main engine bearing;

a crankshaft in operational association with the main engine bearing, the crankshaft having a power take-off (PTO) end with a cavity having a surface with a power transmitting element, the cavity capable of receiving an additional mechanism to transmit power thereto, the crankshaft further including a first oil passage that is centrally disposed with in the PTO end and a second oil passage that intersects the first oil passage; and an oil lubrication pumping mechanism for circulating oil to the main engine bearing and the crankshaft; and circulating oil, using the oil lubrication pumping mechanism, such that lubricating oil flows from the main engine bearing through the second oil passage and the first oil passage, and then to the cavity, thereby lubricating the power transmitting element.

17. The method of claim 16 wherein at least one of the first and the second oil passages includes a flow reducing orifice having a plug secured therein, and the method further comprises controlling, using the plug secured within the flow-reducing orifice, the flow of lubricating oil to the cavity.

18. The method of claim 17 wherein the circulating further comprises lubricating any additional power transmitting element of any additional mechanism that engages the power transmitting element of the crankshaft.

19. The method of claim 18 wherein the additional mechanism having the surface with the additional power transmitting element comprises a clutching mechanism, and the method further includes providing oil via the first oil passage to the cavity and supplying oil from the cavity to the clutching mechanism.

20. The method of claim 19 wherein the oil is provided from the cavity to the clutching mechanism via a receiving passage within the surface having the power transmitting element.

21. The method of claim 16 wherein the power transmitting element is a splined surface and wherein, during engine operation, the circulating of oil to the splined surface is constant.

22. A method for lubricating an engine power transmitting element, the method comprising:

providing a lubrication system, the lubrication system including:

a main engine bearing;

a crankshaft in operational association with the main engine bearing, the crankshaft having a power take-off (PTO) end with a cavity having a surface with a power transmitting element, the cavity capable of receiving an additional mechanism to transmit power thereto, the crankshaft further including a first oil passage that is centrally disposed with in the PTO end and a second oil passage that intersects the first oil passage;

an oil lubrication pumping mechanism for circulating oil to the main engine bearing and the crankshaft; and a mechanism having a return oil path or passageway formed therein;

circulating oil, using the oil lubrication pumping mechanism, such that lubricating oil flows from the main engine bearing through the second oil passage and the first oil passage, and then to the cavity, thereby lubricating the power transmitting element; and returning, via the passageway, the power transmitting element lubricating oil from the cavity to the oil lubrication pumping mechanism;

wherein a constant or substantially constant supply of lubricating oil can be provided to the power transmitting element.

* * * * *